US005389226A

United States Patent [19]

Scruggs et al.

[11] Patent Number: 5,389,226

[45] Date of Patent: Feb. 14, 1995

[54] ELECTRODEPOSITION OF NICKEL-TUNGSTEN AMORPHOUS AND MICROCRYSTALLINE COATINGS

[75] Inventors: David M. Scruggs, Oceanside; Gerald A. Croopnick, Trabuco Canyon, both of Calif.

[73] Assignee: Amorphous Technologies International, Inc., Laguna Niguel, Calif.

[21] Appl. No.: 85,501

[22] Filed: Jun. 30, 1993

Related U.S. Application Data

[63] Continuation-in-part of Ser. No. 992,044, Dec. 17, 1992, abandoned.

[51] Int. Cl.[6] ..... C25D 3/56; C25D 5/50

[52] U.S. Cl. ..... 205/50; 205/227; 205/259

[58] Field of Search ..... 205/50, 227, 255, 259, 205/328

[56] References Cited

U.S. PATENT DOCUMENTS

| | | | |
|---|---|---|---|
| 2,160,321 | 5/1939 | Armstrong et al. | 204/2 |
| 4,019,910 | 3/1977 | Mallory, Jr. | 106/1 |
| 4,529,668 | 7/1985 | Croopnick et al. | 428/665 |

FOREIGN PATENT DOCUMENTS

| | | | |
|---|---|---|---|
| 15743 | 2/1975 | Japan | 205/277 |
| 453444 | 4/1975 | U.S.S.R. | 204/44.5 |

*Primary Examiner*—Kathryn Gorgos
*Attorney, Agent, or Firm*—Gregory Garmong

[57] ABSTRACT

A nickel tungsten-containing coating is electrodeposited onto a substrate from an electrodeposition bath having in solution from about 0.034 to about 0.047 moles per liter of nickel, from about 0.15 to about 0.28 moles per liter of tungsten, from about 0.13 to about 0.43 moles per liter of hydroxycarboxylic acid, and 0 or from about 0.077 to about 0.15 moles per liter of boron. The bath has a pH of from about 6 to about 9, and the electrodeposition is preferably accomplished at a temperature of from about 100° F. to about 140° F.

22 Claims, 3 Drawing Sheets

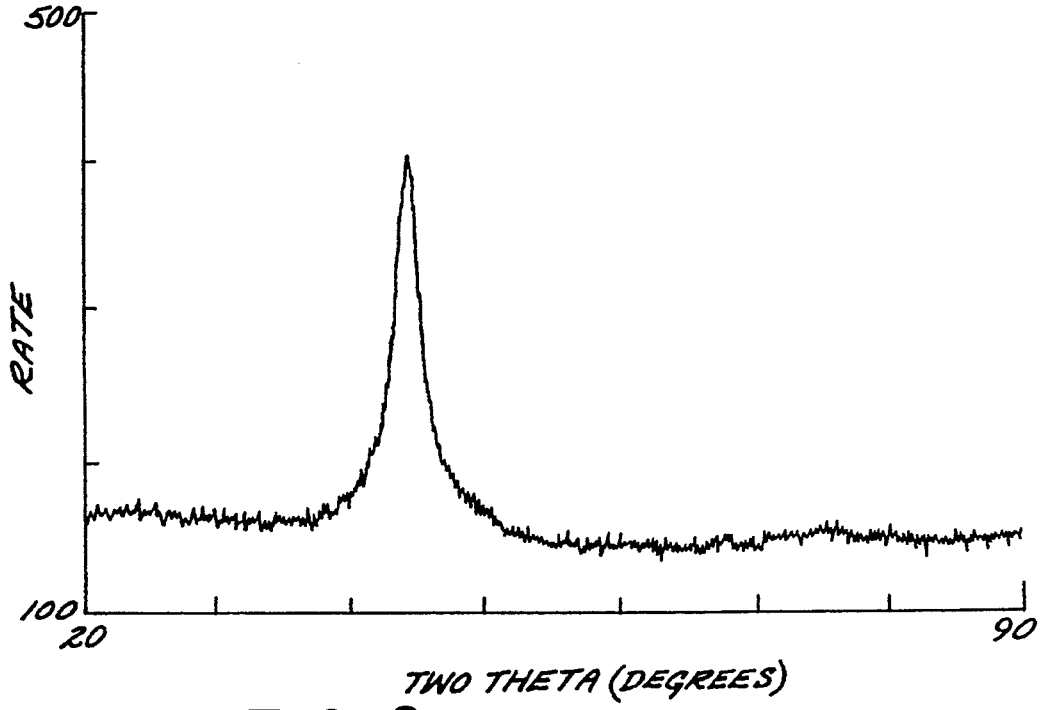
FIG. 3
FIG. 4
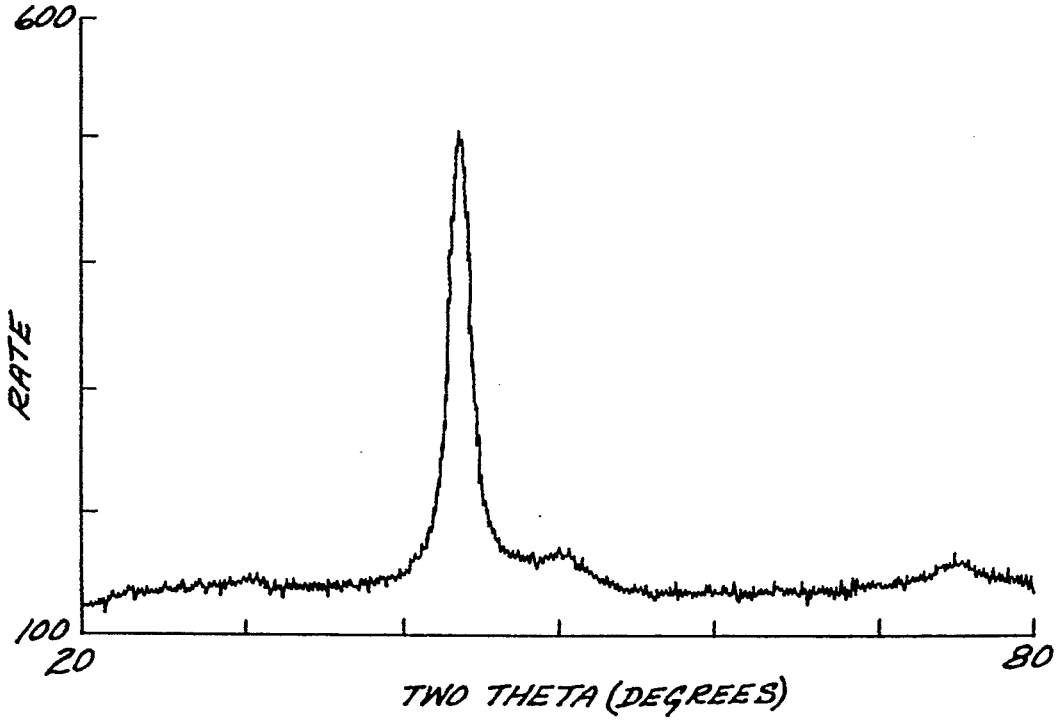

ELECTRODEPOSITION OF NICKEL-TUNGSTEN AMORPHOUS AND MICROCRYSTALLINE COATINGS

This application is a continuation-in-part of application Ser. No. 07/992,044, filed Dec. 17, 1992, now abandoned, for which priority is claimed.

BACKGROUND OF THE INVENTION

This invention relates to electrodeposited coatings, and, more particularly, to such a coating incorporating nickel, tungsten, and boron and that has high hardness but low residual stress.

Coatings are widely used to protect substrates in wear-inducing and/or corrosive environments. A substrate is formed to the required shape and dimensions, and a coating is placed onto the substrate. The material of the substrate is chosen to provide the required combination of strength, toughness, ductility and other properties for the structure, and the coating is chosen to protect the surface of the substrate against hostile environments. The coating must also adhere well to the substrate, and accordingly should have a low residual internal stress that does not cause the coating to delaminate from the substrate.

Amorphous and microcrystalline materials offer promise for use as protective coatings. An amorphous material has no long-range or short-range crystallographic order, and, and therefore, no grain boundaries that can preferentially erode or corrode. Microcrystalline (including nanocrystalline) materials have very small grains, but have been observed to have excellent erosion and corrosion resistance. Certain types of amorphous and microcrystalline materials also exhibit extremely high hardnesses, making them ideal candidates for protective coatings.

To utilize amorphous and microcrystalline materials as protective coatings, techniques must be available to apply the coatings to the surfaces to be protected. It has been known, for example, to deposit molten metals, which naturally have no long-range or short-range order, against a surface so that they solidify rapidly and, in some cases, remain in the disordered state. This rapid solidification approach is practiced for some applications, but not for others such as the coating, of the insides of tubes. High rate solidification also is, by its nature, somewhat uncontrolled, and can lead to variations in thickness and structure. High rate solidification can be accomplished by splatting a molten metal against a surface or by melting a solid surface coating and causing it to freeze rapidly.

Another approach offers the capability to form amorphous and microcrystalline coatings in a more controlled fashion, which can also be used for applications such as the coating of interior regions. In this technique, an electrodeposition bath is prepared from compounds of the elements to be codeposited. A metal is electrodeposited from this bath onto a cathode, depositing as a thin protective coating.

One such electrodeposition approach is described in U.S. Pat. No. 4,529,668. According to this process, a boron-containing amorphous alloy is deposited from a bath containing, for example, ions of tungsten, cobalt, and boron. The resulting tungsten-cobalt-boron compound is amorphous with a high hardness and wear resistance. It may be deposited on exterior and interior surfaces, uniformly and with great control.

One important consideration of any candidate for use in production operations is its economics, and in particular the cost of depositing coatings of preselected thicknesses. When coatings are deposited, the economics can often be expressed in terms of the rate of coating deposition. The slower the rate, the longer the time to deposit a coating of some preselected thickness. The process of the '668 patent deposits its amorphous coating at a rate of about 0.001–0.003 inches in eight hours of deposition. This rate is fully acceptable for many applications. However, this deposition rate may be too slow for other coating requirements.

Thus, there is always an ongoing need for techniques to produce desirable coatings at higher deposition rates. The present invention fulfills this need, and further provides related advantages.

SUMMARY OF THE INVENTION

The present invention provides a process for depositing a nickel/tungsten-based coating onto surfaces, and the resulting coating and coated articles. Preferably, the coating also contains boron. The coating is amorphous, microcrystalline (including nanocrystalline), or a mixture of amorphous and microcrystalline, has high hardness and wear resistance, is corrosion resistant, and has low internal residual stress. The coating process is highly efficient, having a coating efficiency of over 40 percent. The coating can be deposited at rates of up to about 0.014 inches in eight hours, over four times the highest rate previously possible for electrodeposited amorphous coatings when deposited at comparable temperatures. It may also be deposited at lower rates and at relatively lower temperatures that are easier to implement commercially in some cases. The coating is resistant to cracking.

In accordance with the invention, an electrodeposition process for depositing a nickel-tungsten coating onto a substrate includes the steps of preparing an electrodeposition bath comprising in solution from about 0.034X to about 0.047X moles per liter of nickel, from about 0.15X to about 0.28X moles per liter of tungsten, from about 0.13X to about 0.43X moles per liter of hydroxycarboxylic acid, and 0 or from about 0.077X to about 0.15X moles per liter of boron, the bath having a pH of from about 6 to about 9. The scaling factor X can range from about 0.67 to about 1.7. The bath constituents are provided from bath additions of sources such as salts. A nickel-tungsten coating is electrodeposited onto a substrate from the electrodeposition bath.

The resulting coating has a composition in weight percent of about 60 percent nickel, 39 percent tungsten, and 1 percent boron. It has a hardness of about 600 HV (Vicker's Hardness) in the as-plated condition, and the hardness can be increased to 900–1100 HV by heat treating the deposited coating at a temperature of about 600° F. for four hours. The coating is amorphous, microcrystalline (including nanocrystalline), or a mixture of amorphous and microcrystalline, both when deposited and after heat treating.

The coating of the invention can be deposited on exterior surfaces and also interior surfaces of articles, such as the interior bore of a cylinder. It is highly controllable in deposition rate and final characteristics. Deposition and coating modifiers such as brightening agents (for example, butyne diol) and wetting agents (for example, sodium lauryl sulfate) can be added to the deposition bath, to improve the characteristics of the final coating.

The present invention provides an advance in the art of wear-resistant and corrosion-resistant coatings. The coatings are hard, yet have low residual stress. Amorphous and microcrystalline coatings can be prepared at relatively high deposition rates. Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 3 is an X-ray diffraction pattern of a coating that has a mixture of amorphous and nanocrystalline regions;

FIG. 4 is an X-ray diffraction pattern of a nanocrystalline coating; and

DETAILED DESCRIPTION OF THE INVENTION

Figure 1:
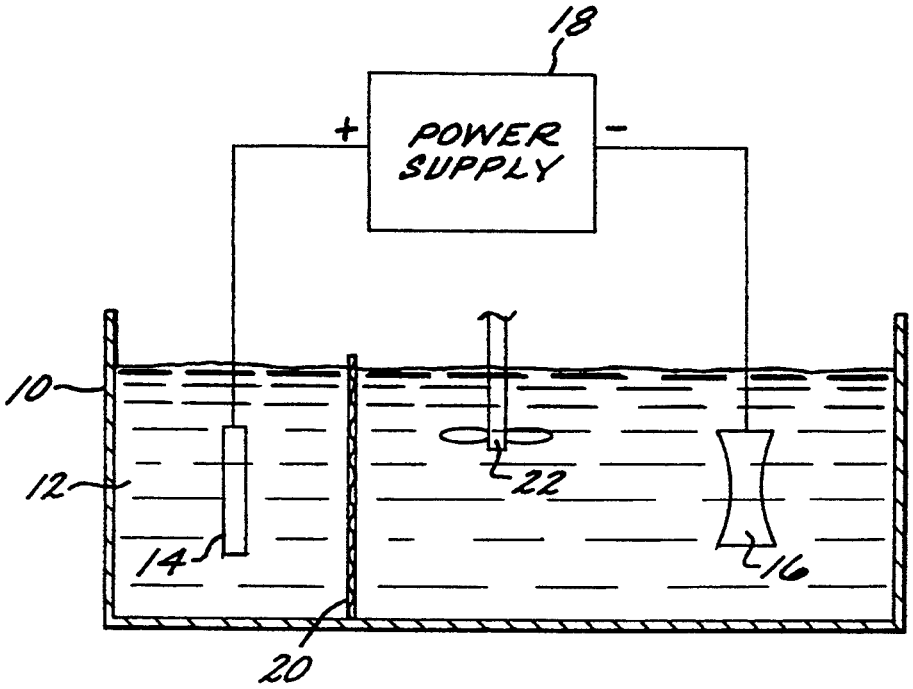
FIG. 1 is a schematic illustration of a preferred electrodeposition apparatus for conducting the process of the invention.

As illustrated in FIG. 1, an electrodeposition process in which the anode is not consumed is typically accomplished in a tank 10 sufficiently large to hold a quantity of an electrodeposition bath 12 containing the elements to be co-deposited. The tank 10 further contains an anode 14 having a positive potential applied thereto and a cathode 15 having a negative potential applied thereto, both immersed in the bath 12. The potentials are applied by a power supply 18 having a current capacity sufficient for the size of the cathode 16. In the presently preferred design, the anode 14 is placed in a sealed anode chamber separated from the remainder of the bath 12 by an ion permeable membrane 20, in an approach familiar to those in the art. The bath 12 is preferably gently stirred by a stirrer 22, and may also be mildly agitated by pumping the electrodeposition bath through the tank. Under the influence of the potential applied across the anode 14 and the cathode 16, dissociated positive species migrate toward the cathode and are deposited thereon, while electrons may be visualized as traveling from the cathode 16 to the anode 14 as the electrodeposition current.

The structure illustrated in FIG. 1 is the presently preferred apparatus for accomplishing the electrodeposition in accordance with the invention, but use of the present invention is not limited to this apparatus. Other means for electrodepositing the coatings may be utilized. For example, the cathode may become a container for the bath, as, for example, where the electrodeposition bath and anode are placed within the container and the negative potential is applied to the container. The coating is thereafter deposited on the inner bore of the cathode/container. A curved or irregularly shaped anode may be provided to conform to a curved or irregularly shaped cathode, facilitating the deposition of a desired coating on the cathode. Such modifications are known to those skilled in the art, and the present invention is compatible with such apparatus modifications.

Figure 2:
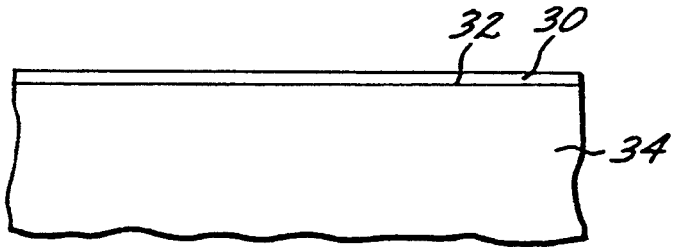
FIG. 2 is a schematic side sectional view of a coated substrate.

The structure produced by the present approach is illustrated in FIG. 2. A coating so of an amorphous-microcrystalline alloy is deposited onto a surface 32 of a substrate 34. The coating 30 is amorphous, microcrystalline (including nanocrystalline), or a mixture of amorphous and microcrystalline regions. The substrate 34 is made the cathode of the cell depicted in FIG. 1 during the electrodeposition process.

The deposition bath 12 is formed from a number of constituent s, each selected for its operability in combination with the other constituents. The bath includes a source of nickel ions which may be chosen from a variety of compounds such as nickel oxide, nickel carbonate, nickel sulfate, nickel chloride, or combinations thereof. The source of nickel preferably provides a nickel concentration in the deposition bath of from about 0.034X to about 0.047X moles per liter, most preferably about 0.046X moles per liter. The symbol X represents a scaling factor that can vary from 0.67 to 1.7, and is selected by the user of the invention. It is used to scale the amounts of all of the constituents of the deposition bath by the same amount, for any particular value of X chosen.

The bath further includes a source of tungsten ions which may be chosen from a variety of compounds such as sodium tungstate, ammonium tungstate, ammonium meta tungstate, tungstic acid, or combinations thereof. The source of tungsten preferably provides a tungsten concentration in the deposition bath of from about 0.15X to about 0.28X moles per liter, most preferably about 0.21X moles per liter.

The bath further includes a source of boron which may be chosen from a variety of compounds such as boron phosphate, boric acid, or combinations thereof. The source of boron preferably provides a boron concentration in the deposition bath of from about 0.077X to about 0.15X moles per liter, most preferably about 0.11X moles per liter.

The bath further includes a source of a hydroxycarboxylic acid, preferably a citrate or a tartrate, or combinations thereof. The source of hydroxycarboxylic acid preferably provides a hydroxycarboxylic acid concentration of from about 0.13X to about 0.43X moles per liter, most preferably about 0.29X moles per liter for a citrate and about 0.29X moles per liter for a tartrate.

In all cases, the same scaling factor X is used to determine the amount of each constituent of the bath. As an example, if the user selected a scaling factor X equal to 1.4, then the preferred concentration of the source of nickel yields a bath nickel content of 0.046 times 1.4 or 0.064 moles per liter; the preferred concentration of the source of tungsten yields a bath tungsten con tent of 0.21 times 1.4 or 0.29 moles per liter; the preferred concentration of the source of boron yields a bath boron content of 0.11 times 1.4 or 0.15 moles per liter; and the preferred concentration of the source of hydroxycarboxylic acid yields a bath hydroxycarboxylic acid content of 0.23 times 1.4 or 0.32 moles per liter for a citrate.

The scaling factor X can vary in the range of from about 0.67 to about 1.7. If X is outside this range, either substantially below or substantially above, the quality of the coating is reduced and becomes unacceptable. Within the range, the selection of a particular value of X is made to achieve particularly preferred properties. For example, characteristics such as deposition efficiency, deposition rate, coating adherence, coating strength, and coating corrosion resistance vary according to the value of the scaling factor selected. In some instances, improved economics of deposition are more important than attaining particular physical properties, and in other cases the opposite may be true. The inventors have found that selection of the scaling factor X of 1.4 yields the best mix of desirable coating properties and economic deposition for their requirements.

Bath deposition conditions are generally common to all compositions. The pH of the bath 12 is adjusted to from about 6 to about 9 by the addition of a base such as sodium hydroxide or ammonium hydroxide to the bath. The temperature of the bath during electrodeposition is preferably about 100° F.–140° F. The higher the deposition temperature, the faster the rate of deposition. However, a particular advantage of the present invention is that relatively high deposition rates can be achieved even for relatively low temperatures such as 120° F. The applied voltage between the anode 14 and the cathode 16 is typically from about 3 to about 8 volts. The current density at the cathode 16 is from about 0.3 to about 1.2 amperes per square inch.

A most-preferred composition of the electrodeposition bath 12 is about 5.8 grams per liter of nickel carbonate, about 70 grams per liter of sodium tungstate, about 53 grams per liter of ammonium citrate monohydrate, and about 6.3 grams per liter of boric acid. The pH is from about 8.4 to about 8.6, and the temperature is about 120° F. A secondary most-preferred composition using other sources of species to be deposited is about 13 grams per liter of nickel sulfate hexahydrate, about 70 grams per liter of sodium tungstate, about 50 grams per liter of ammonium citrate, about 12 grams per liter of boron phosphate. The pH is from about 8.4 to about 8.6, and the temperature is about 120° F. In each case, the deposition temperature may be increased to increase the deposition rate of the coating.

A number of plating characteristics are of interest and importance. The deposition rate is normally preferred to be as great as possible, as the process efficiency is directly related to deposition rate. The rate of thickness buildup of the coating should be as great as possible, consistent with acceptable plating quality and the required hardness. The hardness is related to strength. The hardness tends to predict wear resistance, particularly if the wearing medium is no harder than the plating.

Another important characteristic of the plating is the plating or residual stress in the coating. The lowest residual stress is preferred. When the residual stress is too high, cracking and lifting of the coating from the substrate can be experienced. Where adherence of the coating to the substrate is good, cracking may be acceptable in certain applications, such as some part s of internal combustion engines. However, where corrosion resistance is required, cracking must be avoided completely.

Thus, the preferred electrodeposition bath compositions are those that have deposition rates of at least about 0.4 grams per ampere-hour at a current density of 0.3 amperes per square inch, have a plating thickening rate of at least 19 micrometers per hour, have a minimum microhardness of at least about 900 HV after a 4 hour oven soak at 600° F., and exhibit a qualitative plating stress of less than about 30,000 pounds per square inch (tensile) or in certain cases of no more than about 60,000 pounds per square inch ( tensile ) even at large plating thicknesses and high coating hardness.

A number of samples were prepared and evaluated to establish the limits of the deposition parameters and the nature of the results obtained. The following Table I lists the results of these tests. In Table I, column (1) is an Example number for reference. Column (2) is the current density during deposition in amperes per square inch. Columns (3)–(6) express the electrodeposition bath content. Column (3) is the nickel content expressed as moles per liter of nickel supplied as either nickel carbonate (c) or nickel sulfate (s) or nickel chloride (1) or a mixture (m) of nickel carbonate and nickel chloride. Column (4) is the tungsten content expressed as moles per liter of tungsten supplied as sodium tungstate. Column (5) is the hydroxycarboxylic acid (HCA) content expressed as moles per liter of HCA supplied by ammonium citrate (c) or ammonium tartrate (t). Column (6) is the boron content expressed as moles per liter of boron supplied by boric acid (ba) or boron phosphate (bp). Column (7) is the pH of the electrodeposition bath. Column (8) is the temperature of the electrodeposition bath during deposition. Column (9) is the deposition rate in grams per ampere-hour, a measure of electrodeposition efficiency. Column (10) is the hardness of the coating measured in Vicker's Hardness Number with a 25 gram load, after the substrate and coating have been heat treated for four hours at 600° F. In some cases, incipient cracking of the coating was observed either after deposition or after heat treatment, as indicated by a letter c after the hardness value. Column (11) is the rate of thickness increase of the coating during deposition, in micrometers per hour.

Column (12) is a qualitative coating residual stress index, stated in terms of level 1, level 2, or level 3 residual stress index. To obtain the residual stress index, the coating material was electrodeposited onto one side of a thin strip of steel about 0.6 inches wide and 1.6 inches long. If after plating the strip was flat or nearly so, the coating was nearly free of residual stress, with a residual stress estimated to Be below 30,000 psi (termed Level 1). If after plating, the strip had a bowing of less than about 3–4 millimeters, the residual stress was estimated to be below 60,000 psi (termed Level 2). If after plating the strip was bowed more, the residual stress was estimated to be above 60,000 psi (termed Level 3). Level 1 residual stress is acceptable for all applications, while level 2 residual stress is acceptable for some applications. Level 3 residual stress is not acceptable for the coating.

Table I lists acceptable and preferred compositions.

TABLE I

| (1) No. | (2) Curr. Dens. | (3) Ni | (4) W | (5) HCA | (6) B | (7) pH | (8) Temp. | (9) Dep. Rate | (10) Hard. | (11) Thick. Rate | (12) Resid. Stress |
|---|---|---|---|---|---|---|---|---|---|---|---|
| 1 | 0.3 | 0.047c | 0.21 | 0.23c | 0.10ba | 8.4 | 120 | 0.482 | 1033 | 23 | 1 |
| 2 | 0.75 | 0.047c | 0.21 | 0.23c | 0.10ba | 8.4 | 120 | 0.255 | 974 | 30 | 1 |
| 3 | 0.48 | 0.046s | 0.21 | 0.22c | 0.12bp | 8.4 | 120 | 0.455 | 1003 | 32 | 1 |
| 4 | 1.07 | 0.046s | 0.21 | 0.22c | 0.12bp | 8.5 | 140 | 0.265 | 980 | 45 | 1 |
| 5 | 0.3 | 0.047c | 0.21 | 0.23c | 0.11ba | 8.6 | 120 | 0.452 | 1033 | 21.5 | 1 |
| 6 | 0.3 | 0.047c | 0.21 | 0.22c | 0.10ba | 8.6 | 120 | 0.500 | 989 | 23.8 | 1 |
| 7 | 0.3 | 0.047c | 0.21 | 0.22c | 0.10ba | 8.5 | 120 | 0.456 | 1064 | 21.7 | 1 |
| 8 | 0.3 | 0.047c | 0.21 | 0.22c | 0.08ba | 8.5 | 120 | 0.483 | 1018 | 23 | 1 |
| 9 | 0.3 | 0.046c | 0.21 | 0.15c | 0.10ba | 8.7 | 120 | 0.476 | 940 | 22.7 | 1 |

TABLE I-continued

| (1) No. | (2) Curr. Dens. | (3) Ni | (4) W | (5) HCA | (6) B | (7) pH | (8) Temp. | (9) Dep. Rate | (10) Hard. | (11) Thick. Rate | (12) Resid. Stress |
|---|---|---|---|---|---|---|---|---|---|---|---|
| 10 | 0.3 | 0.047c | 0.21 | 0.26c | 0.10ba | 8.6 | 120 | 0.495 | 1033 | 23.6 | 1 |
| 11 | 0.3 | 0.047c | 0.21 | 0.30c | 0.10ba | 8.6 | 120 | 0.459 | 953 | 21.8 | 1 |
| 12 | 0.3 | 0.047c | 0.15 | 0.22c | 0.10ba | 8.7 | 120 | 0.443 | 940 | 21.1 | 1 |
| 13 | 0.3 | 0.030c | 0.21 | 0.23c | 0.10ba | 8.4 | 120 | 0.400 | 920 | 19.0 | 1 |
| 14 | 0.3 | 0.038c | 0.21 | 0.22c | 0.10ba | 8.5 | 120 | 0.403 | 1115 | 19.2 | 1 |
| 15 | 0.3 | 0.054c | 0.21 | 0.22c | 0.10ba | 8.5 | 119 | 0.523 | 940 | 24.9 | 1 |
| 16 | 0.3 | 0.065c | 0.30 | 0.31c | 0.14ba | 8.5 | 120 | 0.496 | 989 | 23.6 | 2 |
| 17 | 0.4 | 0.065c | 0.30 | 0.31c | 0.14ba | 8.4 | 120 | 0.512 | 1064 | 32.5 | 2 |
| 18 | 0.5 | 0.065c | 0.30 | 0.31c | 0.14ba | 8.4 | 120 | 0.456 | 1049 | 36.2 | 1 |
| 19 | 0.6 | 0.065c | 0.30 | 0.31c | 0.14ba | 8.5 | 120 | 0.408 | 1033 | 38.5 | 2 |
| 20 | 0.5 | 0.079c | 0.36 | 0.38c | 0.17ba | 8.5 | 120 | 0.508 | 894 | 40.3 | 1 |
| 21 | 0.55 | 0.079c | 0.36 | 0.38c | 0.17ba | 8.4 | 120 | 0.461 | 1064 | 40 | 1 |
| 22 | 0.6 | 0.079c | 0.36 | 0.38c | 0.17ba | 8.5 | 120 | 0.442 | 974 | 41.7 | 1 |
| 23 | 0.5 | 0.047c | 0.21 | 0.26t | 0.10ba | 8.5 | 120 | 0.444 | 981 | 34.0 | 1 |
| 24 | 0.3 | 0.048c | 0.21 | 0.22c | 0.11ba | 8.5 | 120 | 0.434 | 946 | 19.8 | 1 |
| 25 | 0.5 | 0.046c | 0.21 | 0.22c | 0.12bp | 6.4 | 120 | 0.251 | 1048 | 19.0 | 1 |
| 26 | 0.5 | 0.077s | 0.35 | 0.37c | 0.20bp | 6.5 | 121 | 0.237 | 1064 | 19.0 | 1 |
| 27 | 0.3 | 0.046c | 0.21 | 0.15c | 0.10ba | 8.7 | 120 | 0.476 | 940 | 22.7 | 1 |

Of these acceptable examples, nos. 3, 18, 20, and 21 are most-preferred. These specimens plate with low stress, have a thickness buildup of at least 30 micrometers per hour, have a deposition rate of at least 0.45 grams per ampere-hour, and have a hardness of at least 900 HV. The The following Table II lists marginal specimens.

TABLE II

| (1) No. | (2) Curr. Dens. | (3) Ni | (4) W | (5) HCA | (6) B | (7) pH | (8) Temp. | (9) Dep. Rate | (10) Hard. | (11) Thick. Rate | (12) Resid. Stress |
|---|---|---|---|---|---|---|---|---|---|---|---|
| 28 | 0.3 | 0.047c | 0.21 | 0.22c | 0.15ba | 8.7 | 120 | 0.448 | 946 | 21.3 | 2 |
| 29 | 0.3 | 0.047c | 0.21 | 0.23c | 0.03ba | 8.6 | 120 | 0.492 | 882 | 23.4 | 1 |
| 30 | 0.3 | 0.047c | 0.21 | 0.23c | 0 | 8.5 | 120 | 0.509 | 894 | 24.3 | 1 |
| 31 | 0.3 | 0.047c | 0.27 | 0.22c | 0.10ba | 8.6 | 120 | 0.460 | 974 | 21.9 | 2 |
| 32 | 0.3 | 0.047c | 0.28 | 0.29c | 0.10ba | 8.6 | 120 | 0.403 | 985 | 19.2 | 2 |
| 33 | 0.3 | 0.047c | 0.21 | 0.22c | 0.10ba | 9.1 | 120 | 0.447 | 938 | 21.0 | 2 |
| 34 | 0.3 | 0.047c | 0.21 | 0.22c | 0.10ba | 9.0 | 100 | 0.390 | 870 | 18.6 | 1 |

The samples in the marginal group generally electroplate well, but show medium levels of residual stress or are low in the rate of thickness buildup, deposition rate, and/or hardness. Generally, as the composition or deposition conditions depart further from the preferred ranges, more than one parameter deteriorates. In example 28, with boron at the high end, the residual stress increases and the hardness is moderate. In examples 29 and 30, with boron at the low end, the hardness falls to barely acceptable levels. The absence of boron in example 30 causes the sample to become nanocrystalline rather than amorphous. The high tungsten level of example 31 results in increased residual stress in the coating. The elevated tungsten and hydroxycarboxylic acid levels of example 32 result in reduced deposition rate and rate of thickness increase, as well as increased residual stress. The high pH of example 33 causes increased plating stress and moderated hardness. The reduced plating temperature of example 34 lowers the deposition rate and rate of thickness buildup, and reduces the hardness significantly.

Table III lists unacceptable electrodeposition bath compositions and/or conditions.

TABLE III

| (1) No. | (2) Curr. Dens. | (3) Ni | (4) W | (5) HCA | (6) B | (7) pH | (8) Temp. | (9) Dep. Rate | (10) Hard. | (11) Thick. Rate | (12) Resid. Stress |
|---|---|---|---|---|---|---|---|---|---|---|---|
| 35 | 0.7 | 0.047c | 0.21 | 0.22c | 0.10ba | 8.4 | 160 | 0.398 | 946 | 44.3 | 2c |
| 36 | 0.3 | 0.055c | 0.21 | 0.22c | 0.10ba | 8.6 | 120 | 0.520 | 824 | 24.8 | 2 |
| 37 | 0.3 | 0.064c | 0.21 | 0.22c | 0.10ba | 8.5 | 120 | 0.521 | 858 | 24.8 | 3 |
| 38 | 0.3 | 0.039c | 0.21 | 0.22c | 0.10ba | 8.6 | 120 | 0.374 | 960 | 17.8 | 2 |
| 39 | 0.3 | 0.035c | 0.21 | 0.22c | 0.075ba | 8.6 | 120 | 0.401 | 803 | 19.1 | 1 |
| 40 | 0.3 | 0.047c | 0.21 | 0.23c | 0.016ba | 8.6 | 120 | 0.492 | 790 | 23.4 | 3 |
| 41 | 0.3 | 0.047c | 0.21 | 0.23c | 0.05ba | 8.5 | 120 | 0.494 | 835 | 23.5 | 1 |
| 42 | 0.3 | 0.047c | 0.21 | 0.22c | 0.10ba | 8.4 | 140 | 0.507 | 782 | 24.2 | 3c |
| 43 | 0.5 | 0.032c | 0.14 | 0.17t | 0.07ba | 8.9 | 120 | 0.239 | 960 | 19.0 | 2 |
| 44 | 0.8 | 0.032c | 0.14 | 0.17t | 0.07ba | 8.9 | 180 | 0.445 | 907 | 35.3 | 2 |
| 45 | 0.3 | 0.030c | 0.21 | 0.22c | 0.10ba | 8.5 | 120 | 0.336 | 1003 | 16.0 | 1 |

Example 35 demonstrates that increasing the current density and temperature produces a marginal deposition rate and results in high stress and cracking of the coating. As shown in examples 36 and 37, increased nickel content results in low hardness and increasing residual stress. Low nickel content results in low deposition rate and low rate of thickening, and increased stress, as shown in example 38. Example 39 shows that low nickel and boron produce a coating having a low hardness. A very low boron content is worse than no boron, since the residual stress is very high and the hardness is low, example 40.

A low boron content results in improved, but still low, hardness, example 41. Example 42 shows that lower deposition temperature yields an acceptable deposition rate, but high residual stress in the coating and low hardness. In example 42, a lower concentration bath with tartrate as the hydroxycarboxylic acid produces a low deposition rate and high residual stress. Example 44 utilizes a high deposition temperature and current density to improve deposition rate and rate of thickening, but also results in a high residual stress. Operation at 180° F. is also more difficult than at lower temperatures. Example 45 illustrates the effect of excessively low nickel content. The deposition rate and the rate of thickness buildup of the coating are very low.

Figure 5:
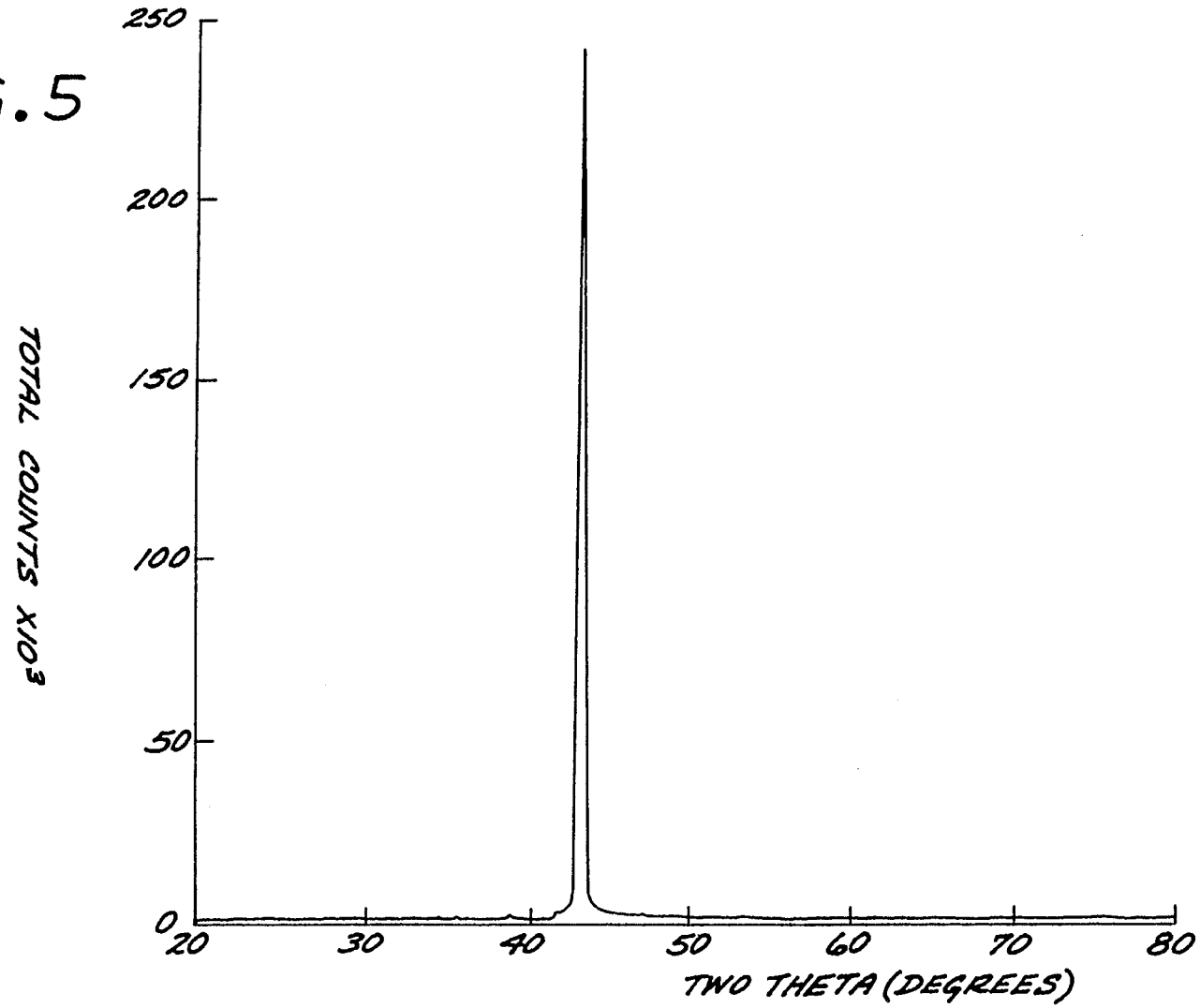
FIG. 5 is an X-ray diffraction pattern of a crystalline coating.

FIG. 3 is an X-ray diffraction pattern, using copper K-alpha radiation, of the coating of Example 24, a mixed amorphous and nanocrystalline coating. There is a short, wide peak at about 44 degrees two-theta, corresponding to nearest neighbor diffraction, and a broad secondary peak at 70–80 degrees two-theta, corresponding to second-nearest neighbor diffraction. This X-ray diffraction structure is to be contrasted with that of FIG. 4, for the coating of Example 30. This coating has a nanocrystalline structure. There is a first crystalline peak at about 44 degrees two-theta and a second crystalline reflection at about 50 degrees two-theta due to (211) reflections. A further peaks is found at 75 degrees two-theta. The principal peak is nominally 1.5 degrees wide at half height, corresponding to a crystallite size of about 7 nanometers. FIG. 5, presented is for comparison, the X-ray diffraction pattern of Example 45, which 1s fully crystalline and has sharp X-ray diffraction peaks.

Although particular embodiments of the invention have been described in detail for purposes of illustration, various modifications may be made without departing from the spirit and scope of the invention. Accordingly, the invention is not to be limited except as by the appended claims.

What is claimed is:

1. An electrodeposition process for depositing a nickel-tungsten coating onto a substrate, comprising the steps of:

preparing an electrodeposition bath comprising in solution from about 0.034X to about 0.047X moles per liter of nickel, from about 0.15X to about 0.28X moles per liter of tungsten, from about 0.13X to about 0.43X moles per liter of hydroxycarboxylic acid, and boron in an amount selected from the group of zero boron and from about 0.077X to about 0.15X moles per liter of boron, where X is a scaling factor of from about 0.67 to about 1.7 and the bath has a pH of from about 6 to about 9; and electrodepositing a coating onto a substrate from the electrodeposition bath.

2. The process of claim 1, wherein the bath has a composition of about 0.046X moles per liter of nickel, about 0.21X moles per liter of tungsten, about 0.23X moles per liter of hydroxycarboxylic acid, and about 0.11X moles per liter of boron.

3. The process of claim 1, wherein the nickel is supplied by a nickel-containing constituent selected from the group consisting of nickel carbonate, nickel sulfate, nickel chloride, nickel oxide, and combinations thereof.

4. The process of claim 1, wherein the tungsten is supplied by a tungsten-containing constituent selected from the group consisting of sodium tungstate, ammonium tungstate, ammonium meta tungstate, tungstic acid, and combinations thereof.

5. The process of claim 1, wherein the hydroxycarboxylic acid is supplied by a constituent selected from the group consisting of ammonium citrate and ammonium tartrate.

6. The process of claim 1, wherein the boron is supplied by a constituent selected from the group consisting of boric acid, boron phosphate, and combinations thereof.

7. The process of claim 1, wherein the step of electrodepositing is accomplished at a temperature of from about 100° F. to about 140° F.

8. The process of claim 1, wherein the step of electrodepositing is accomplished at a cathodic current density of from about 0.3 amperes per square inch to about 1.2 amperes per square inch.

9. The process of claim 1, including the additional step, after the step of electrodepositing, of heating the coated substrate to a temperature of from about 400° F. to about 700° F.

10. The process of claim 1, wherein the electrodeposition bath further comprises a substance selected from the group consisting of a leveling agent, a brightening agent, and a wetting agent.

11. A substrate having a coating prepared by the process of claim 1.

12. An electrodeposition process for depositing a nickel-tungsten coating onto a substrate, comprising the steps of:

preparing an electrodeposition bath comprising in solution from about 0.034X to about 0.047X moles per liter of nickel, the nickel being provided by a bath addition of a nickel-containing constituent selected from the group consisting of nickel carbonate, nickel sulfate, nickel chloride, nickel oxide, and combinations thereof, from about 0.15X to about 0.28X moles per liter of tungsten, the tungsten being provided by a bath addition of a tungsten-containing constituent selected from the group consisting of sodium tungstate, ammonium tungstate, ammonium meta tungstate, tungstic acid, and combinations thereof, from about 0.13X to about 0.43X moles per liter of hydroxycarboxylic acid, the hydroxycarboxylic acid being provided by a bath addition of a hydroxycarboxylic acid-containing constituent selected from the group consisting of ammonium citrate and ammonium tartrate, and from about 0.077X to about 0.15X moles per liter of boron, the boron being provided by a bath addition of a boron-containing constituent selected from the group consisting of boric acid, boron phosphate, and combinations thereof, where X is a scaling factor of from about 0.67 to about 1.7 and the bath has a pH of from about 6 to about 9; and electrodepositing a nickel-tungsten-boron coating onto a substrate from the electrodeposition bath.

13. The process of claim 12, wherein the step of electrodepositing is accomplished at a temperature of from about 100° F. to about 140° F.

14. The process of claim 12, wherein the step of electrodepositing is accomplished at a cathodic current density of from about 0.3 amperes per square inch to about 1.2 amperes per square inch.

15. The process of claim 12, including the additional step, after the step of electrodepositing, of heating the coated substrate to a temperature of from about 400° F. to about 700° F.

16. The process of claim 12, wherein the electrodeposition bath further comprises a substance selected from the group consisting of a leveling agent, a brightening agent, and a wetting agent.

17. The process of claim 12, wherein the bath has a composition of about 0.046X moles per liter of nickel, about 0.21X moles per liter of tungsten, about 0.23X moles per liter of hydroxycarboxylic acid, and about 0.11X moles per liter of boron.

18. A substrate with a nickel-tungsten-boron coating prepared by the process of claim 12.

19. An electrodeposition process for depositing a nickel-tungsten coating onto a substrate, comprising the steps of:

preparing an electrodeposition bath comprising in solution from about 0.065 to about 0.079 moles per liter of nickel, from about 0.30 to about 0.35 moles per liter of tungsten, from about 0.31 to about 0.38 moles per liter of citrate, and from about 0.14 to about 0.17 moles per liter of boric acid; and electrodepositing a coating onto a substrate from the electrodeposition bath.

20. The process of claim 19, wherein the nickel is supplied as nickel carbonate, the tungsten is supplied as sodium tungstate, and the citrate is supplied as ammonium citrate.

21. An electrodeposition process for depositing a nickel-tungsten coating onto a substrate, comprising the steps of:

preparing an electrodeposition bath comprising in solution from about 0.046 to about 0.054 moles per liter of nickel, from about 0.15 to about 0.30 moles per liter of tungsten, from about 0.15 to about 0.26 moles per liter of citrate, and from about 0.08 to about 0.11 moles per liter of boric acid; and electrodepositing a coating onto a substrate from the electrodeposition bath.

22. The process of claim 21, wherein the nickel is supplied as nickel carbonate, the tungsten is supplied as sodium tungstate, and the citrate is supplied as ammonium citrate.

* * * * *